US005848518A

United States Patent [19]

Bufalini et al.

[11] Patent Number: 5,848,518

[45] Date of Patent: Dec. 15, 1998

[54] ENVELOPE THROAT OPENING MECHANISM FOR INSERTING MACHINE

[75] Inventors: Vincent D. Bufalini, Norwalk; Christopher DeBarber, Woodbury; Thomas M. Lyga, Torrington; William A. Ross, Darien, all of Conn.

[73] Assignee: Pitney Bowes Inc., Stamford, Conn.

[21] Appl. No.: 896,013

[22] Filed: Jul. 17, 1997

[51] Int. Cl.[6] ..... B65B 43/30; B65B 43/34

[52] U.S. Cl. ..... 53/569; 53/284.3

[58] Field of Search ..... 53/284.3, 569, 53/460, 459

[56] References Cited

U.S. PATENT DOCUMENTS

| | | | |
|---|---|---|---|
| 2,914,895 | 12/1959 | Martin . | |
| 4,337,609 | 7/1982 | Foster et al. | 53/284.3 X |
| 4,418,515 | 12/1983 | Foster et al. | 53/457 |
| 4,548,400 | 10/1985 | Foster et al. | 53/284.3 X |
| 4,922,689 | 5/1990 | Haas et al. | 53/569 |
| 5,430,990 | 7/1995 | Long | 53/569 X |
| 5,517,797 | 5/1996 | Ballard et al. | 53/569 X |
| 5,630,312 | 5/1997 | Ballard et al. | 53/284.3 X |

*Primary Examiner*—Horace M. Culver
*Attorney, Agent, or Firm*—Charles R. Malandra, Jr.; Melvin J. Scolnick

[57] ABSTRACT

An envelope throat opening mechanism for an envelope inserting machine includes a pair of envelope throat opening claw assemblies mounted adjacent an envelope inserting position for opening the outer ends of an envelope disposed in the envelope inserting position to permit insert material to be inserted into the envelope. An envelope throat opening tongue assembly is also disposed adjacent the envelope inserting position and in substantial alignment with the center of an envelope, the tongue assembly having a tongue mounted therein for movement into the throat of the envelope adjacent the center thereof to ensure that the center portion of the throat is opened sufficiently to permit the insert material to be inserted into the envelope. There is means for driving the claw assemblies and the tongue assembly in a timed sequence with the arrival of an envelope at the inserting position, and with the claw assemblies operating asynchronously with respect to the mounting means for the tongue to move the claws into the throat of the envelope in advance of the tongue entering the throat, so that both the outer ends of the envelope and the center portion thereof are effectively opened by the claws and the tongue respectively.

10 Claims, 15 Drawing Sheets

ENVELOPE THROAT OPENING MECHANISM FOR INSERTING MACHINE

CROSS REFERENCE TO OTHER APPLICATIONS

This application discloses and claims an improvement in the invention disclosed and claimed in copending application Ser. No. 08/895,871, filed on Jul. 17, 1997, and assigned to the assignee of this application.

BACKGROUND OF THE INVENTION

The present invention relates generally to the field of machines for inserting material into envelopes, and more particularly to an improved mechanism for opening the throats of envelopes disposed at an inserting position to permit collations of insert material to be inserted into the envelopes.

The above referenced prior application discloses and claims an improvement in the envelope throat opening mechanism of an envelope inserting machine. Reference is hereby made to the Background of the Invention portion of the specification in that application for a general discussion of the disadvantages of, and problems encountered with, the throat opening mechanisms of prior art envelope inserting machines. Reference is also made to the Brief Summary of the Invention portion of the specification in that application for a discussion of the manner in which the invention disclosed and claimed in that application substantially overcomes these disadvantages and problems.

Notwithstanding the substantial extent to which the prior invention avoids the disadvantages and problems of the prior art envelope throat opening mechanisms, considerable experimentation and testing have revealed one design aspect of that invention that from time to time created a problem not previously anticipated, and which adversely affected the reliability of that throat opening mechanism to open the full length of the throats of all types of envelopes regardless of the configuration of the throats and physical characteristics of the envelopes. The problem was that when the outer claws and the center tongue commenced and ended their respective throat opening cycles of operation at the same time, certain conditions could occur in which the center tongue would miss the throat of the envelope and fail to open it. This was due to the fact that when the end claws enter the envelope throat, they tend to push up very slightly on the ends of envelope at about the time that the center tongue is about to enter the throat. This pushing up motion on the ends of the envelope may shift the center of the envelope slightly away from the center tongue and cause it to miss the throat, since prior to opening the envelope, the throat is very small, if almost non-existent. One solution that was tried was to provide a back stop specifically for the center tongue, and this did alleviate the problem to some extent. However, the back stop did not eliminate the problem for the reason that the envelopes do not necessarily press against the back stop when they enter the insert position, which allowed the throat to move away slightly from the position of the back stop if the end claws raised the envelope during opening, and it was found to be quite difficult to adjust the position of the back stop so that every envelope pressed against it in the insert position to ensure that the center tongue did not miss the throat.

Another solution that was tried without success was to provide the front of the center tongue with a relatively sharp edge, and adjust the path of travel of the edge so that it would scrape along the underside of the envelope flap and the underside of the front panel so as to effectively scrape the throat open. This technique was undesirable because of the tendency of the sharp edge to either cut into the front panel of certain types of envelopes or tear the "glassine" windows from envelopes that have this feature, hereby creating a snag point for the insert material entering the envelope. Therefore, it is highly desirable to avoid a scraping technique for assuring that the center tongue enters the throats of the envelopes, since the disadvantages of this technique typically outweigh the advantages.

Thus, it was apparent that there was a need for an improvement in the prior envelope throat opening mechanism that would assure that the center tongue would enter the envelope throat to open it with total reliability, regardless of whether the envelope was precisely located against the back stop or slightly spaced therefrom, and again regardless of the physical nature and configuration characteristics of the envelopes.

BRIEF SUMMARY OF THE INVENTION

The present invention provides a highly effective solution to the foregoing problem by providing a driving arrangement for the outer claw assemblies and the center tongue in which the outer claws are caused to enter the envelope throat before the center tongue enters the throat so that the center portion of the envelope is partially open before the center tongue begins its forward travel into the envelope throat. By having the end claws enter the envelope and at least partly if not fully open the outer ends of the throat before the center tongue enters the throat, the center portion of the throat will be partly opened by the end claws, and even if this opening is relatively small, such as an eighth of an inch, it is sufficient to ensure that the center tongue can enter the throat without having a path of travel of the forward edge of the center tongue redesigned to forcefully scrape along the underside of the front panel of the envelope.

This is accomplished in the present invention by designing the drive for the outer claw assemblies as an intermittent gear drive in which the drive ratio between two gear elements in the drive is approximately 2:1. By doing this, the outer claws enter the throat and pull the ends thereof open in the same manner as in the prior throat opening mechanism, after which the center tongue commences its throat opening cycle of operation to enter and open the center portion of the throat. The invention further contemplates that the same common source of drive for both the end claw assemblies and the center tongue assembly is utilized to still drive both assemblies in their respective cycles of operation.

In its broader aspects, the principles of the invention are embodied in an envelope throat opening mechanism for an envelope inserting machine which has means for storing a plurality of envelopes, means defining an envelope inserting position in spaced relationship with the envelope storing means in which insert material is adapted to be inserted into the envelopes, and means for feeding envelopes seriatim from the storage means to the inserting position. In this environment, the envelope throat opening mechanism comprises a pair of envelope throat opening claw assemblies disposed in the envelope inserting machine adjacent the outer ends of the throat of an envelope in the inserting position, each of the claw assemblies having a claw mounted therein for movement into the throat of the envelope adjacent the outer ends to open the throat to permit insert material to be inserted into the envelope. An envelope throat opening center tongue assembly disposed in the envelope inserting machine in substantial lateral alignment with the center of the throat of an envelope in the inserting position for opening the center portion of the throat of the envelope positioned in the inserting position. There is means for driving said claw assemblies and said center tongue assembly in a timed sequence with the arrival of the envelope at the envelope inserting position, and with the claw assemblies operating asynchronously with respect to the center tongue assembly to cause the claw assemblies to open the outer ends of the throat prior to the center tongue assembly opening the center portion of the throat, whereby the outer ends of the throat are fully opened prior to the center tongue assembly opening the center portion of the tongue to ensure that the center tongue assembly effectively opens the center portion of the throat.

In some of its more limited aspects, the center tongue assembly comprises an elongate, generally rectangular throat opening tongue having a forward edge that is positioned in substantial longitudinal alignment with the claws of the claw assemblies, and means mounting the tongue for compound movement such that the forward edge of the tongue moves into the throat of the envelope adjacent the center thereof in response to operation of the driving means for opening the center portion of the throat. The means for driving the claw assemblies and the mounting means for the tongue comprises a drive shaft rotatably mounted in the envelope inserting machine, actuating means for the claw assemblies and the tongue mounting means connected to the drive shaft for moving both the claws and the tongue, and means for rotating the drive shaft. The actuating means comprises a first actuating means for causing the compound movement of the tongue mounting means to move the forward edge of the tongue into the throat of the envelope, and second actuating means for causing the claw assemblies to move the claws into the throat of said envelope, the second actuating means including means for causing the claws to enter the throat of the envelope in advance of the forward edge of the tongue entering the throat of the envelope by the first actuating means.

Further, the first actuating means comprises cam means mounted on the drive shaft for rotation therewith, and means interconnecting the cam means with the tongue mounting means for moving the tongue mounting means through the compound movement to move the forward edge of the tongue into the throat of the envelope during a predetermined amount of rotation of the drive shaft and the cam means. The second actuating means comprises a first driving element mounted on the drive shaft within each of the claw assemblies for rotation with the drive shaft, a second driving element rotatably mounted within each of the claw assemblies for moving the claws, and means interconnecting the first and second driving elements for driving the second driving element at a slower speed than the first driving element.

Preferably, the means interconnecting the first and second driving elements comprises the first and second driving elements being first and second gears having a drive ratio of approximately 2:1 such that the second gear travels approximately twice the distance of the first gear for a given amount of rotation of the drive shaft, such that the claws are thereby moved at approximately twice the speed of the forward edge of the tongue. The 2:1 drive ratio is achieved by the first gear being approximately twice the diameter of the second gear so that the second gear is driven through a full revolution in response to the first gear being driven through one half of a revolution by the drive shaft.

Finally, the means interconnecting the first and second driving elements further includes means for permitting the second gear to remain stationary while the first gear is driven through the remaining half of a revolution by the drive shaft, and this means comprises the first gear having teeth over approximately only one half of the periphery thereof, the remaining portion of the periphery thereof being a smooth surface.

Having briefly described the general nature of the present invention, it is a principal object thereof to provide an envelope throat opening mechanism for an envelope inserting machine which consistently and reliably avoids the problem encountered with the prior throat opening mechanism utilizing a center tongue assembly for opening the center portion of envelope throats.

Another object of the present invention is to provide an envelope throat opening mechanism for an envelope inserting machine that opens the center portion of envelope throat while still maintaining a non-scraping clearance between the front edge of the center tongue and the underside of the front panel of an envelope.

It is still another object of the present invention to provide an envelope throat opening mechanism for an envelop inserting machine which is inexpensive to manufacture, highly reliable in operation and requires little if any user maintenance.

These and other objects and features of the present invention will become more apparent from an understanding of the following detailed description of a presently preferred embodiment of the invention, which considered in conjunction with the accompanying drawings.

DESCRIPTION OF THE DRAWINGS

FIGS. 11A and 11B through 18A and 18B are simplified side views of the four bar linkage assembly driving the center envelope throat opening tongue through the various positions illustrated in FIG. 5, and the end claw assemblies in the positions these assemblies occupy during a cycle of operation in opening both the center portion and end portion of an envelope throat.

DETAILED DESCRIPTION OF THE INVENTION

Figure 1:
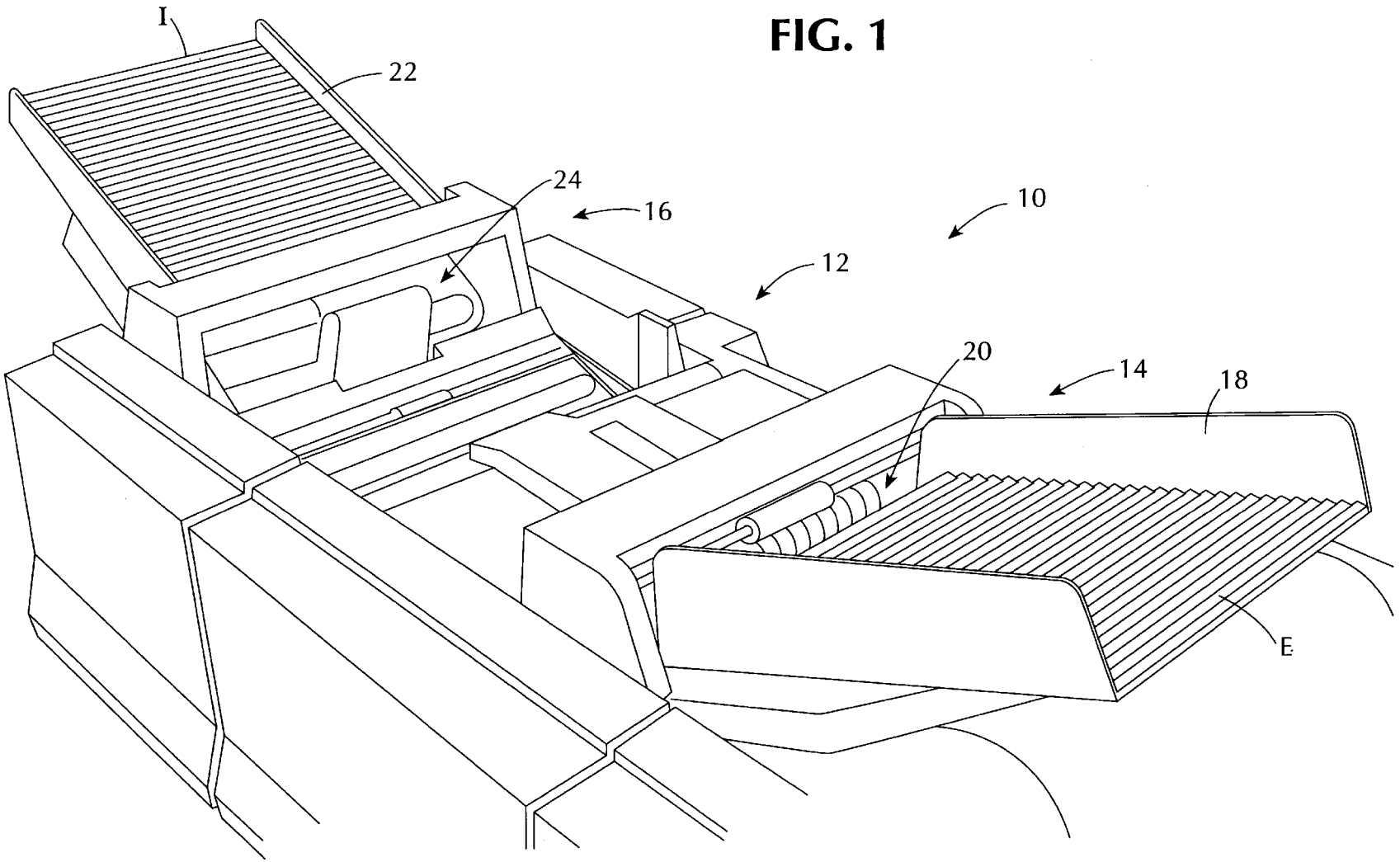
FIG. 1 is a perspective view of a typical envelope inserting machine showing an envelope inserting module with envelope and insert material storing, feeding and separating modules associated therewith, and which includes the novel envelope throat opening mechanism of the present invention.

Referring now to the drawings, and more particularly to FIG. 1 thereof, the envelope throat opening mechanism of the present invention is embodied in an envelope inserting machine, of which there are several types commercially available. For the purpose of showing the envelope throat opening mechanism in an operative environment, a typical arrangement of an envelope inserting machine, designated generally by the reference numeral 10, is shown in the figure and which includes an envelope inserting module, designated generally by the reference numeral 12, an envelope storing, feeding and separating module, designated generally by the reference numeral 14, and an insert material storing, feeding and separating module, designated generally by the reference numeral 16. It should be understood that the insert material module 16 is, again, merely representative of a large variety of insert material storing and/or feeding modules which are available and which can be suitably connected to and used with, either individually or in a successive arrangement, the envelop feeding and inserting modules 14 and 12 respectively.

The envelope storing, feeding and separating module 14 includes a suitable hopper 18 which holds a plurality of envelopes E in a fanned relationship so that successive envelopes can be grasped and fed by a suitable feeder/separator unit, designated generally by the reference numeral 20 to the envelope inserting module 12. Similarly, the insert material storing, feeding and separating module includes a suitable hopper 22 which holds a plurality of insert material I in a fanned relationship so that successive items of insert material can be grasped and fed by another suitable feeder/separator unit 24 to the envelope inserting module 12.

Figure 2:
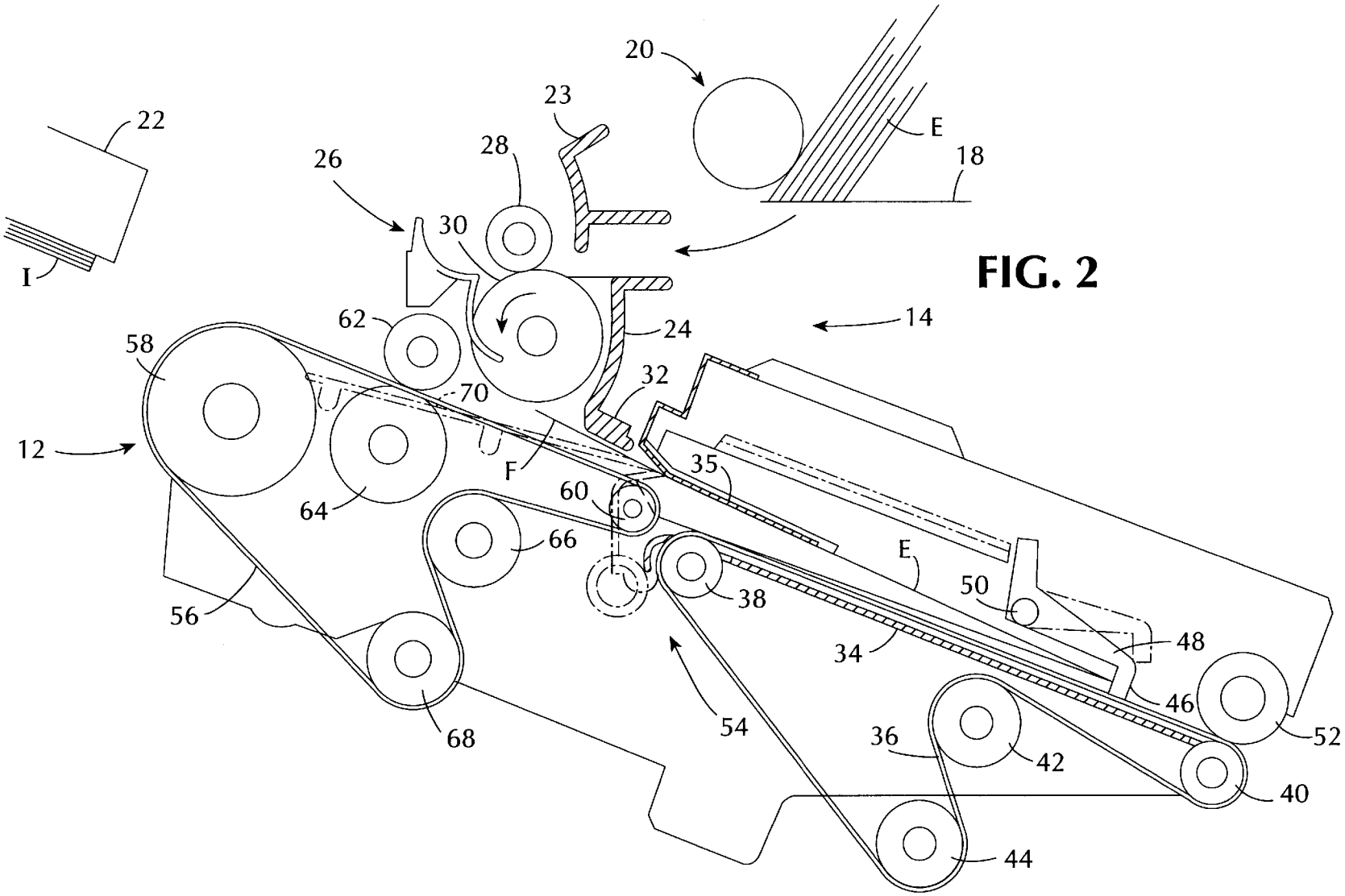
FIG. 2 is a fragmentary side, partly sectional, view of the envelope inserting machine shown in FIG. 1 with certain portions removed to show internal detail, and showing an envelope in the envelope inserting position.
Figure 3:
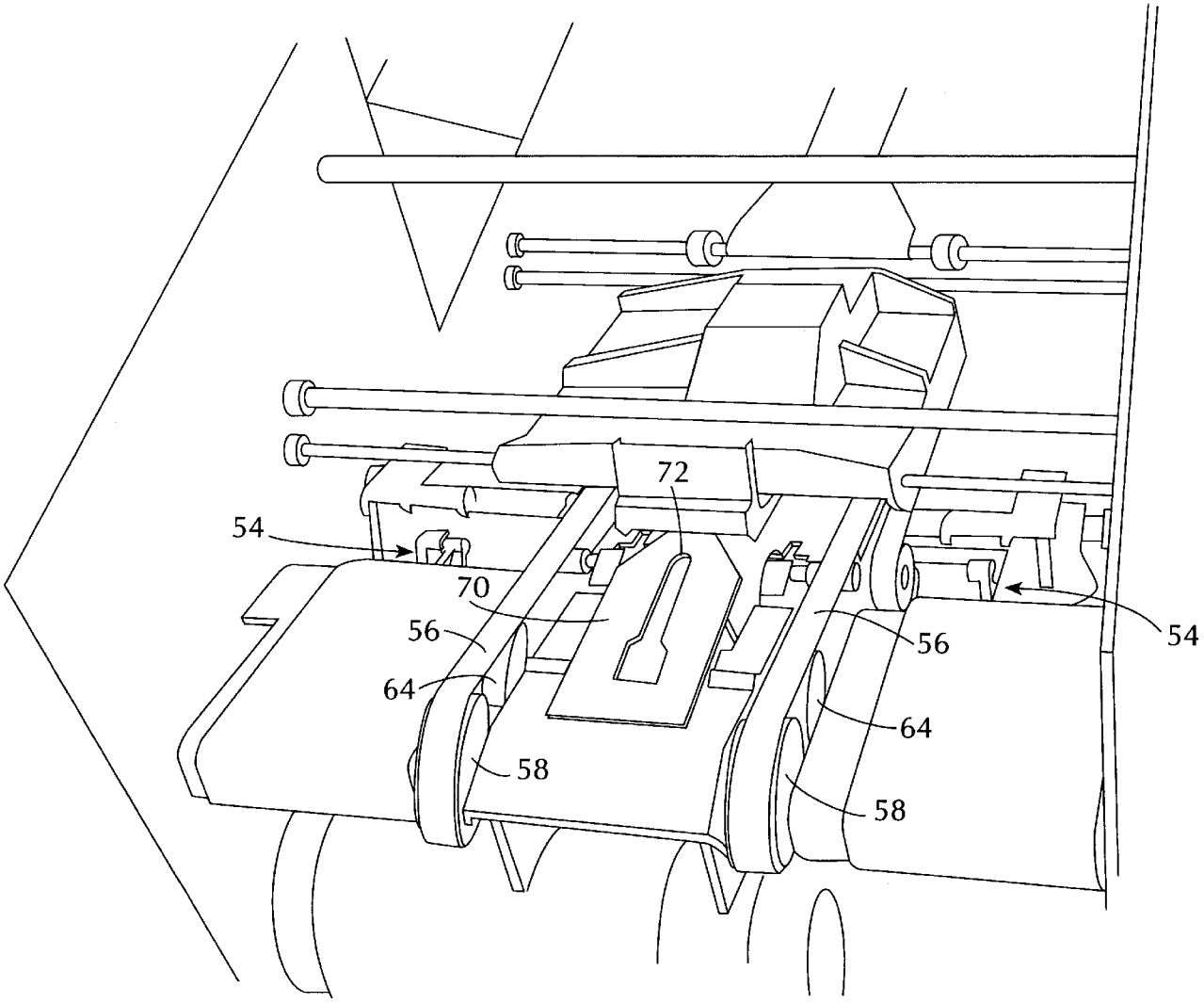
FIG. 3 is a perspective view of a portion of the envelope inserting machine shown in FIG. 1 looking from the insert material storing, feeding and separating module, with the envelope hopper at the right end of the machine removed to reveal detail therebeneath.

Referring now to FIGS. 2 and 3, it will be seen that the envelope storing, feeding and separating module further includes suitable guide members 23 and 24 which define a feed path for envelopes E that are moved from the hopper 18 by the feeder/separator unit 20. In known manner, the envelopes E are stored in the hopper 18 with the bottom edges resting on the floor of the hopper and the flaps of the envelopes closed, and the envelopes are fed through a known flapping device, designated generally by the numeral 26, in which the flaps of the envelopes are opened as they are fed through the flapping device 26 by a pair of cooperating feed rollers 28 and 30. Another suitable guide member (not shown) cooperates with a lower flange 32 of the guide member 24 to direct the bottom edge of the envelope around the bottom of the feed roller 30 and into a means defining an envelope inserting position which is located generally beneath the hopper 18 of the envelope storing, feeding and separating module 14. The means defining the envelope inserting position comprises a suitable plate or deck 34 suitably mounted on a frame portion of the envelope inserting module 12. A pair of laterally spaced feed belts 36 extend around longitudinally spaced rollers 38 and 40 disposed adjacent opposite ends of the envelope inserting position, suitable drive rollers 42 and tensioning rollers 44 so that the belts 36 receive the envelopes from the feed rollers 28 and 30 and convey the envelopes fully into the envelope inserting position until the bottom edge of the envelopes abut a pair of suitable laterally spaced stop members 46. The stop members 46 are downwardly extending fingers connected to levers 48 pivotally mounted as by the pins 50 to a portion of the frame of the module 12, the levers being suitably solenoid actuated so as to raise the stop members 46 from the solid line position to the dotted line position shown in FIG. 2 after a collation of insert material, as further described below, has been inserted into the envelope. When the stop members 46 are raised, the envelope E is moved toward the right as viewed in FIG. 2 by the belts 36 and is ejected from the machine by suitable backup pressure rollers 52 positioned over the rollers 40.

As will be described in more detail hereinbelow, a pair of outer envelope throat opening claw assemblies, designated generally by the numeral 54 in FIGS. 2 and 3, are suitably mounted on the frame of the envelope inserting module 12 so as to be closely adjacent to the entry end of the envelope inserting position, as best seen in FIG. 2. The construction and operation of the claw assemblies 54 will be further described below, it being sufficient at this point to understand only that the claw assemblies 54 operate to open the outer end portions of the throats of successive envelopes in timed sequence with the arrival of envelopes E in the insert position by the belts 36.

Referring still to FIGS. 2 and 3, the envelope inserting module 12 includes a pair of laterally spaced feed belts 56 which extend around a pair of longitudinally spaced rollers 58 ad 60. A pressure roller 62 is positioned over each of the belts 56, and a backup roller 64 supports each of the belts 56 opposite the pressure rollers 62 to support the belts at the point where the pressure rollers 62 press insert material into firm driving engagement with the upper surface of the belts 56. The belts 56 also extend around suitable drive rollers 66 and tensioning rollers 68.

As best seen in FIG. 3, an envelope throat opening center tongue assembly 69 is mounted in the envelope inserting module 12 intermediate the insert feeding belts 56 and in substantial alignment with the center of the throat of an envelope in the inserting position. The center tongue assembly 69 includes a throat opening tongue 70, the forward end 72 of which is in generally lateral alignment with the outer claw assemblies 54. Again, as with the outer claw assemblies 54, the manner in which the center tongue 70 is mounted and the operation of the tongue assembly 69 will be fully described below, it being sufficient at this point to understand only that the tongue 70 operates in synchronism with operation of the outer claw assemblies 54 to open the center portion of the throat of successive envelopes in timed sequence with the arrival of the envelopes in the insert position by the belts 36.

Figure 4:
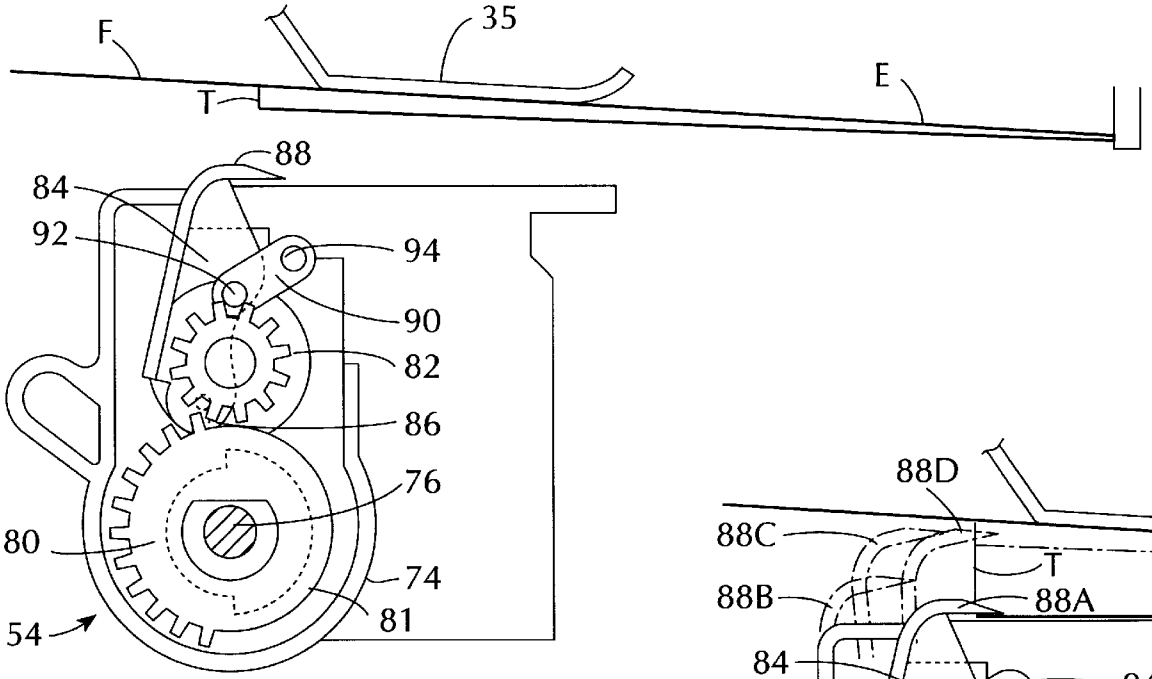
FIG. 4 is a side view of one of the outer claw assemblies shown in its normal or home position.
Figure 5:
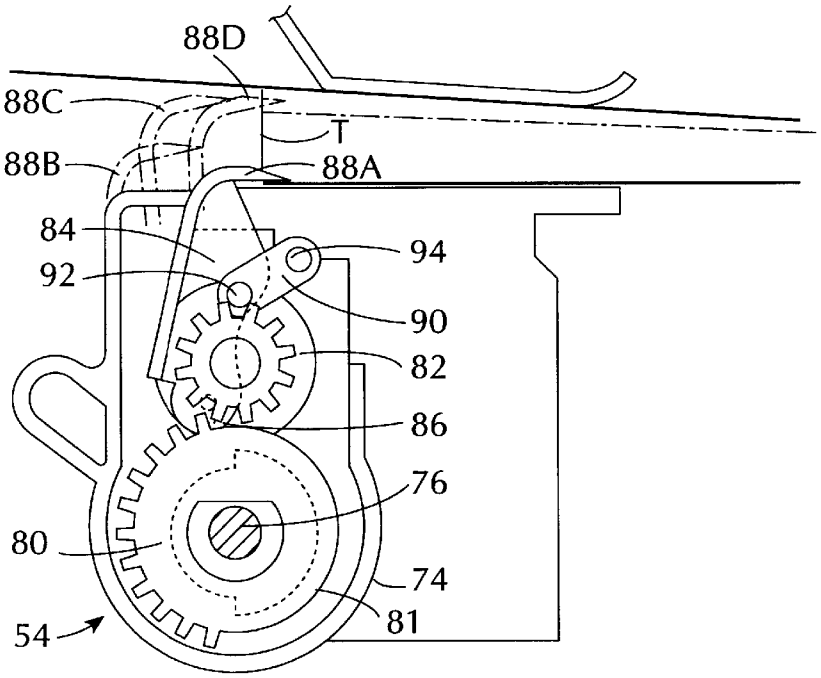
FIG. 5 is a view similar to FIG. 4 but showing the positions of the throat opening claw during a complete cycle of operation of the claw assembly.
Figure 6:
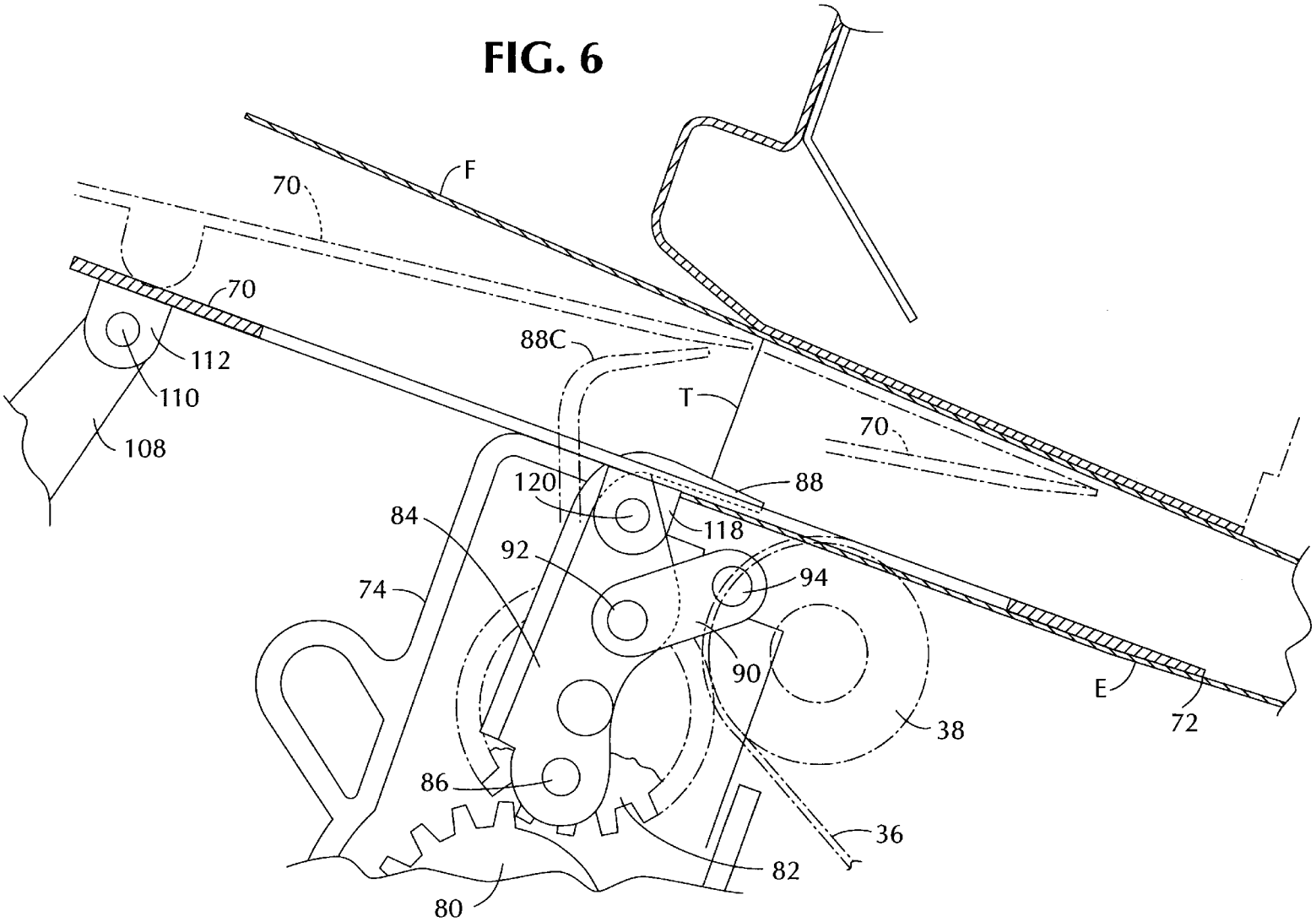
FIG. 6 is a side, partly sectional, view of the outer claw operatively engaged with an envelope as viewed in FIG. 3.

With reference now to FIGS. 4 through 6, the outer claw assemblies 54 each comprise a housing 74 suitably mounted on a portion of the frame of the envelope inserting module 12. A drive shaft 76 is suitably rotatably mounted in the frame of the inserting module 12 (FIG. 7) and extends from one claw assembly 54 to the other. A gear 78 (FIG. 7) is mounted on the shaft 76 by which it is rotated to drive both the claw assemblies 54 and the center tongue assembly hereinafter described. Each of the claw assemblies 54 includes a drive gear 80 mounted on the shaft 76 for rotation therewith, and a driven gear 82 which is driven by the drive gear 80. It will be seen that the driven gear 82 is approximately one half the diameter of the drive gear 80, but the number of teeth on each gear is almost equal, the driven gear 82 having 12 teeth extending around the periphery of the gear, and the drive gear 80 having 11 teeth extending around only about one half of the periphery of the gear. The other approximately one half of the periphery of the drive gear 80 has a flat surface 81 which provides a dwell portion of approximately one half of a revolution of the shaft 76 during which the drive gear 80 does not drive the driven gear 82. With this arrangement, it will be understood that the driven gear 82 will make one complete revolution during approximately one half of a revolution of the drive gear 80, after which the driven gear 82 will remain stationary during the remaining approximately one half revolution of the drive gear 80, all for a purpose more fully explained below in connection with the cyclical operation of the end claw assemblies 54 and the center tongue assembly yet to be described.

Still referring to FIGS. 4 through 6, the lower end of an upstanding link 84 is eccentrically pivotally connected to the driven gear 82 as by a pivot pin 86, the link 84 having a substantially right angled claw 88 on the upper end thereof. One end of another link 90 is pivotally connected to the link 84 as by a pivot pin 92 disposed at an intermediate location on the link 84 between the pivot pin 86 and the claw 88. The other end of the link 90 is pivotally connected as by a pivot pin 94 to a portion of the housing 74.

The construction and arrangement of the links 84 and 90, and the pivotal connections 92 and 94 therebetween, as well as the pivotal connection 86 between the lower end of the link 84 and the gear 82, is such that upon rotation of the shaft 76 and the drive gear 80, the lower end of the link 84 is driven in an orbital path commensurate with the orbital path of the pivot pin 86 about the axis of the gear 82. However, since the link 84 is connected to the link 90 at the pivot point 92, the upper end of the link 84 which carries the claw 88 is constrained to move in an orbital path that is indicated by the solid line position designated 88A, and the three dotted line positions designated 88B, 88C and 88D respectively, as shown in FIG. 5.

It should be clear without further description that the position of the claw 88 shown in FIG. 4, and in the solid line position 88A in FIG. 5, represents the home position of the claw 88 both at the beginning of an inserting cycle when an envelope E has just reached the envelope inserting position, as shown in FIG. 4, and when the claw 88 has completed a throat opening cycle of operation and has opened the throat T of the envelope E in the inserting position as shown in FIGS. 5 and 6. The dotted line positions 88B, 88C and 88D indicate the approximate orbital path of the claw 88 in moving from the home position through the three successive dotted line positions and back to the home position during one revolution of the drive shaft 76 and the drive gear 80, during which the claw 88 first moves rearwardly and upwardly from the position 88A to the position 88B, then further upwardly to an upper most position 88C, also shown in FIG. 6, then forwardly and into the throat T of the envelope E to the position 88D, and finally downwardly back to the home position 88A to open the throat T.

Referring now to FIGS. 7 through 10, the tongue 70 is supported by a mounting means, designated generally by the reference numeral 100, which supports the tongue 70 for compound movement that causes the forward edge 72 of the tongue moves into an opens the center portion of the throat of an envelope disposed in the envelope insert position as indicated by the envelope E in FIG. 2. The tongue mounting means, as further described below, comprises a four element linkage assembly in which three links and the tongue are pivotally connected together to form a parallelogram, with the link opposite to the tongue being pivotally connected to a portion of the inserting machine. By drive means further described below, when horizontal and vertical vectors of motion are imparted to the parallelogram, the tongue 70 is moved in both horizontal and vertical vectors to cause the lead edge 72 to enter the throat of the envelope E and open it a predetermined distance.

Figure 7:
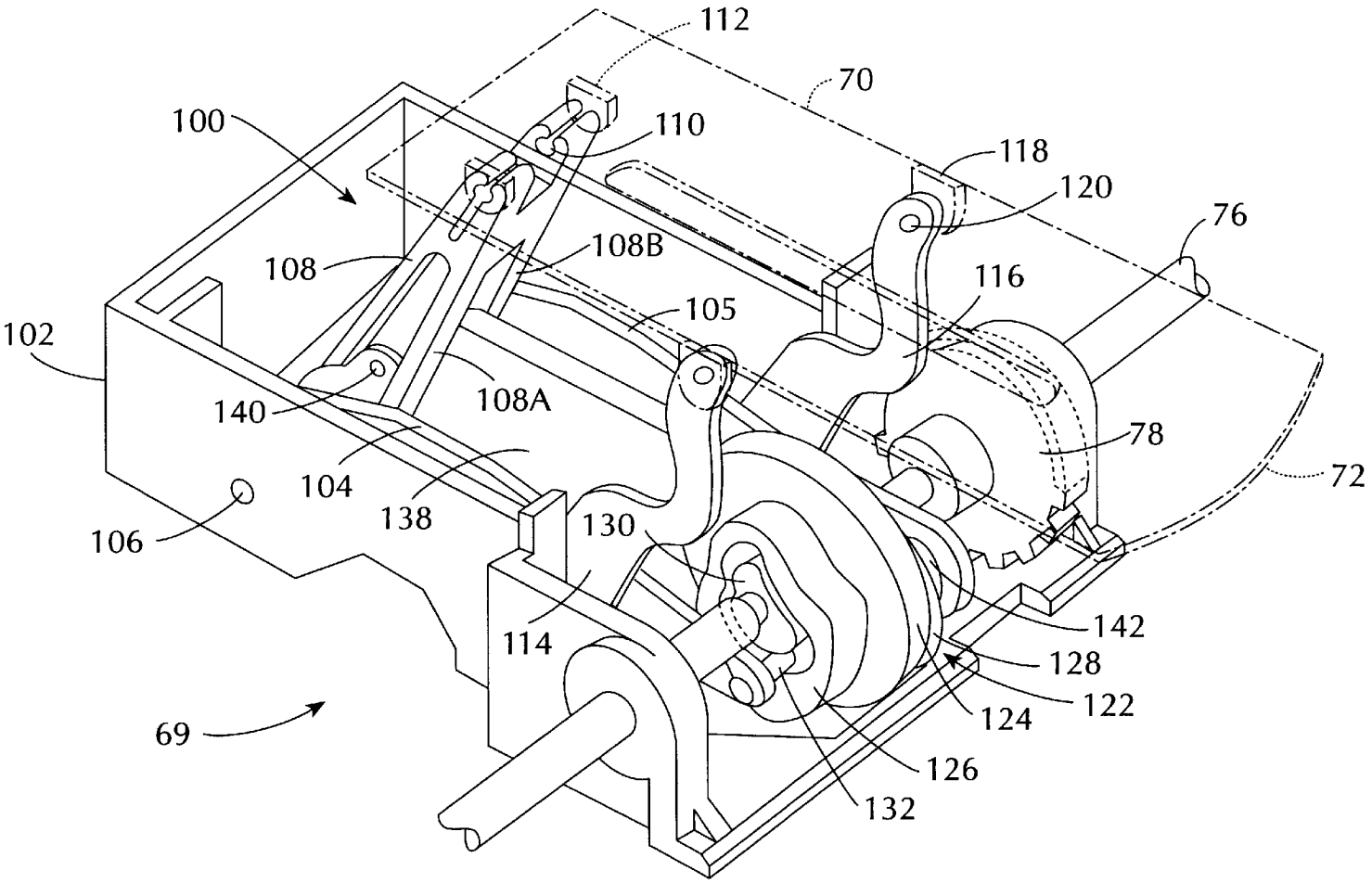
FIG. 7 is a perspective view of the four bar linkage assembly that drives the center envelope throat opening tongue through the positions illustrated in FIG. 5

Thus, as best seen in FIG. 7, the entire tongue mounting means 100 is mounted as hereinafter described in a generally rectangular frame 102 which is suitably mounted in a portion of the envelope inserting machine 12 such that the tongue 72 is in substantial lateral alignment with the center of the throat of an envelope E disposed in the insert position, as seen in FIG. 3. The tongue mounting means 100 comprises a pair of laterally spaced apart elongate right and left lower links 104 and 105 respectively looking in a direction toward the forward edge 72 of the tongue 70. The rear ends of the lower links 104 and 105 are pivotally connected to the frame 102 by means of a pivot shaft 106 which extends from one side of the frame 102 to the other. The lower links 104 and 105 extend forwardly in a generally horizontal orientation from the pivot shaft 106, and terminate adjacent the main drive shaft 76, as further explained below.

The tongue mounting means 100 further comprises a first generally vertically oriented link 108 pivotally connected at its lower end to the pivot shaft 106, and is suitably pivotally connected at its upper end to the under surface of the tongue 70, as by a pin 110 which passes through apertures in the upper end of the link 108 and downwardly projecting tabs 112 connected to the under surface of the tongue 70 (FIG. 7).

Figure 8:
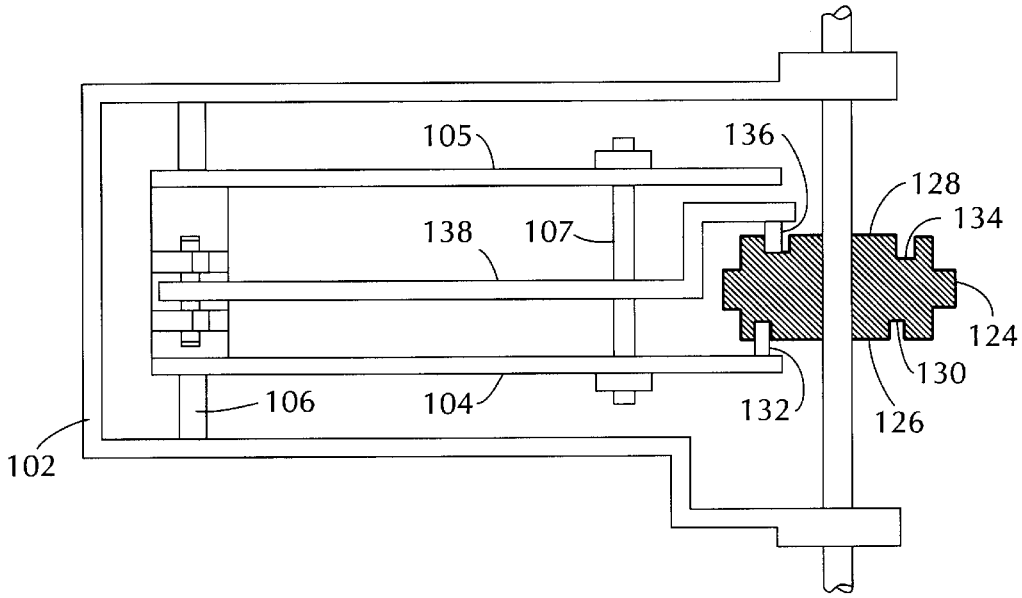
FIG. 8 is a top view, partly in section, of the four bar linkage assembly shown in FIG. 7.

The tongue mounting means further comprises a pair of second, laterally spaced apart, generally vertically oriented right and left links 114 and 116, again looking in a direction toward the forward edge 72 of the tongue 70. The upper ends of the links 114 and 116 are also suitably pivotally connected to the under surface of the tongue 70 in a manner similar to that for the upper end of the rear link 108, as by the downwardly projecting tabs 118 and the pins 120. The lower ends of the links 114 and 116 are pivotally connected to the lower horizontally oriented links 104 and 105 respectively by means of a shaft 107 which extends laterally between the lower links 104 and 105 at a location spaced rearwardly from the forward end of the lower link 104, as best seen in FIG. 8. It will be understood that the right and left vertically oriented links 114 and 116 function as a single link since they are both connected to the tongue 70, and a single link interconnected between the shaft 107 and the tongue 70 could be utilized. But the provision of two vertically oriented links 114 and 116 provides greater stability for the tongue 70 in that it is supported at three locations rather than two.

From the foregoing, it will be seen that the lower links 104 and 105, the first vertically oriented link 106, the pair of second vertically oriented links 114 and 116, and the tongue 70 constitute the above mentioned four element linkage assembly in all of the connections of the links, both to each other and to the tongue, are pivotal so that all of the elements can move relative to each other in the manner yet to be described.

With reference still to FIGS. 7 through 10, the tongue mounting means is moved through the aforementioned compound motion to move the forward end 72 of the tongue 70 into the throat of an envelope by an actuating means, designated generally by the reference numeral 122 in FIG. 7. The actuating means 122 comprises a cam means which is preferably formed as a unitary cam element 124 fixedly mounted on the drive shaft 76 for rotation therewith, the cam element 124 having oppositely facing right and left surfaces 126 and 128 respectively, again looking in a direction toward the forward edge 72 of the tongue 70. It should be apparent that separate cam elements could be utilized to perform the function of each surface of the unitary cam element 124.

Figure 9:
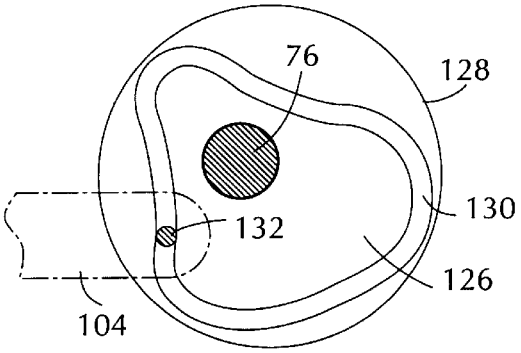
FIGS. 9 and 10 are side views of the cam assembly that drives the four bar linkage assembly shown in FIGS. 7 and 8
Figure 10:
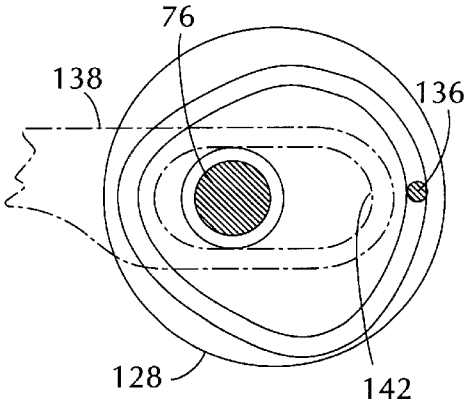

With reference still to FIGS. 7 through 10, the right cam surface 126 is provided with a cam trace 130, in the form of a groove that is suitably formed into the surface of the cam element 124 and having the general configuration shown in FIG. 9. A pin 132 is mounted on the forward end of the lower right link 104 and extends into the trace 130 and functions as a cam follower so as to be moved in a generally vertical direction so as to impart generally vertical movement to the upstanding pair of forward links 114 and 116 via the shaft 107. In a similar manner, as seen in FIG. 10, the left cam surface 128 is provided with a cam trace 134, which is also in the form of a groove that is machined into the surface of the cam element 124 and having the general configuration as shown in FIG. 9. Another pin 136 is mounted adjacent the forward end of an intermediate link 138 and extends into the trace 134, and also functions as a cam follower so as to be moved in a generally horizontal direction so as to impart generally vertical movement to the intermediate link 138. The intermediate link 138 extends generally horizontally from the drive shaft 76 to the rear vertically oriented link 108, to which it is pivotally connected by means of the pin 140. As best seen in FIG. 7, the rear link 108 is bifurcated so that the rear end of the intermediate link 138 can be connected between the legs 108A and 108B of the link 108. The forward portion of the intermediate link 138 is provided with a horizontally oriented elongate aperture 142 through which the drive shaft 76 extends, the purpose of this aperture being to form a sliding support for the forward end of the intermediate link 138 as it is moved in a horizontal reciprocating movement.

A complete cycle of operation of the center tongue assembly and the end claw assemblies will now be described with reference to FIGS. 11A and 11B through 18A and 18B, wherein FIGS. 11A and B represent the home positions of the tongue assembly parts and the claw assembly parts respectively at the beginning of a cycle of operation of the envelope inserting machine 10. Thus, in this position, an envelope E is shown in the inserting position as shown in FIG. 2, and the tongue 70 is in its forward most and lowest position underlying an upper portion of the envelope adjacent the throat T. The angular position of the cam element 124 is such that the cam follower 132 is in its lowest position in the cam trace 130, as seen in FIG. 9, and the cam follower 136 is in its forward most position in the cam trace 134, as seen in FIG. 10. At the same time, as seen in FIG. 11B, the claw 88 is in its lower most position with the tip thereof substantially underneath the throat T, and the lead tooth 80A of the drive gear 80, considered in the direction of rotation of the shaft 76 set forth below, is in engagement with one of the teeth on the driven gear 82.

Figure 12A:
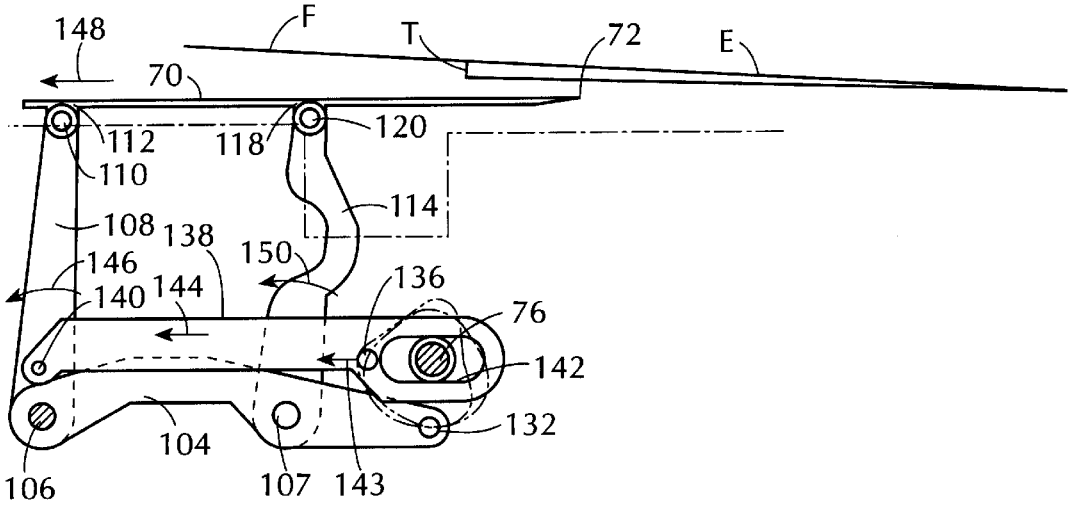
Figure 12B:
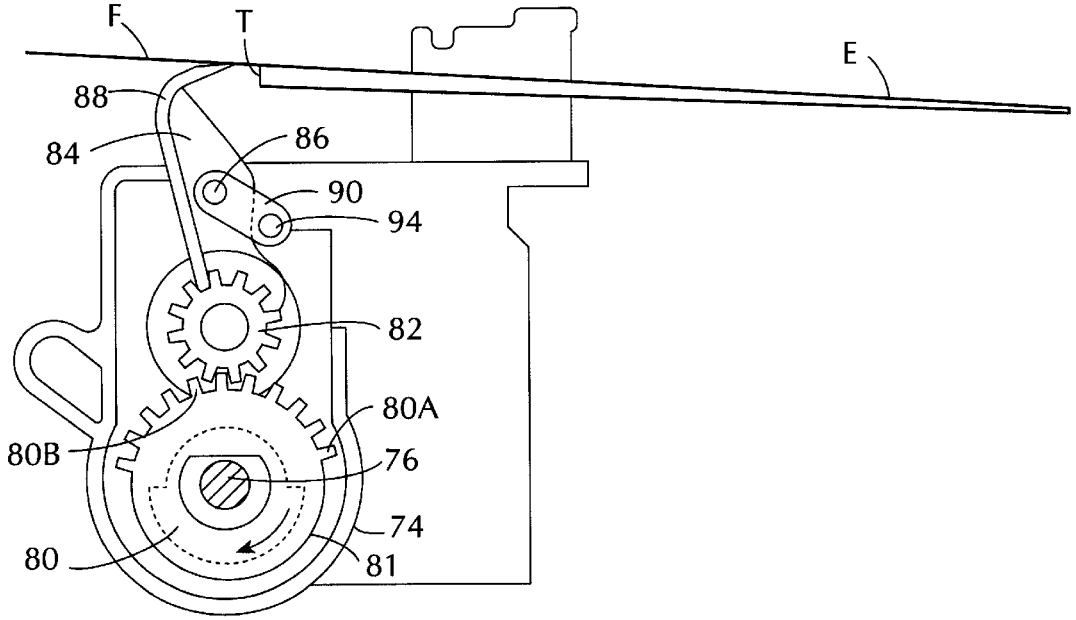

At an appropriate moment after the envelope E reaches the inserting position as determined by the envelope stop elements 46, a suitable microprocessor, which controls all of the functions of the envelope inserting machine 10 in known manner, causes the shaft 76 to commence rotation is a clockwise direction as viewed in FIG. 12A, thereby rotating the cam traces 130 and 134 therewith, which in turn cause the cam followers 132 and 136 to move. As seen in FIG. 12A, the cam trace 134 causes the cam follower 136 to move rearwardly, as indicated by the arrow 143, thereby moving the intermediate link 138 rearwardly as indicated by the arrow 144. Since the intermediate link 138 is pivotally connected to the rear link 108 by the pin 140, the rearward movement of the intermediate link 138 causes the rear link 108 to rotate in a counter clockwise direction about the pivot shaft 106, as indicated by the arrow 146. Further, since the rear link 108 is pivotally connected to the tongue 70 by the pivot pin 110, the angular movement of the rear link 108 moves the tongue 72 rearwardly, as indicated by the arrow 148, and since the tongue 70 is also pivotally connected to the forward links 114 and 116 by the pivot pins 120, the tongue 70 also moves these links in a counter clockwise direction about the pivot shaft 107, as indicated by the arrow 150. The foregoing motions of the parts described occur during the first approximately 80° of rotation of the shaft 76 and the cam element 124.

Figure 15A:
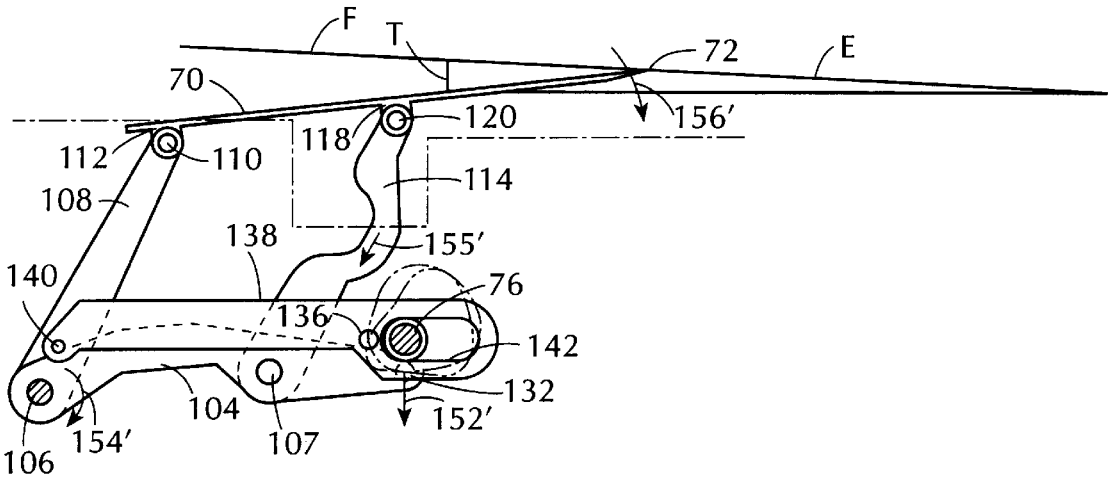
Figure 15B:
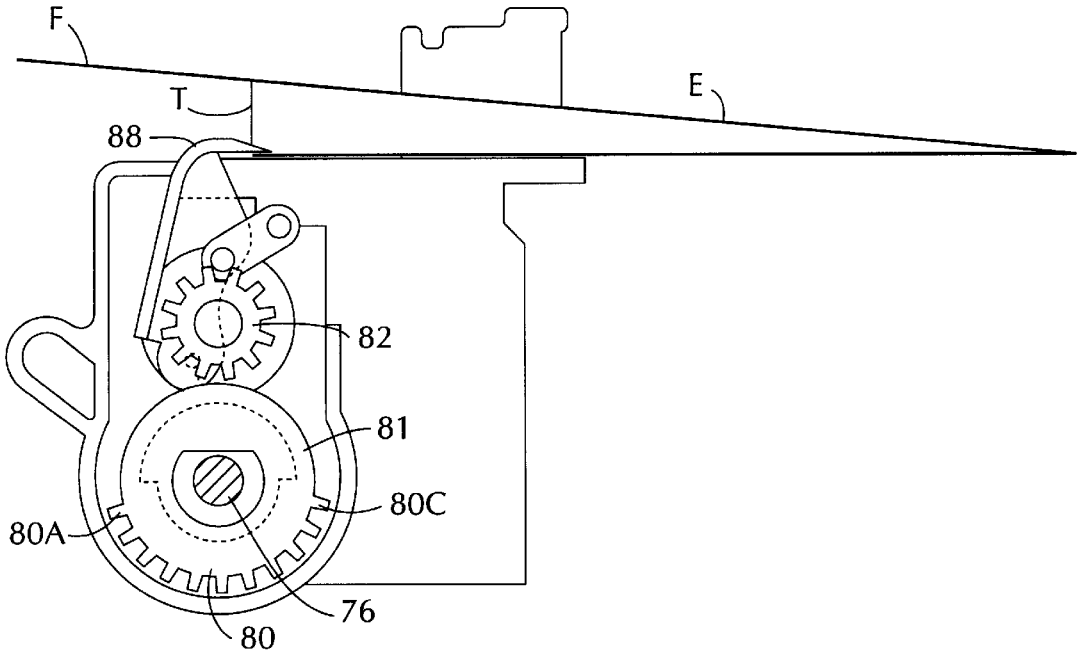
Figure 16A:
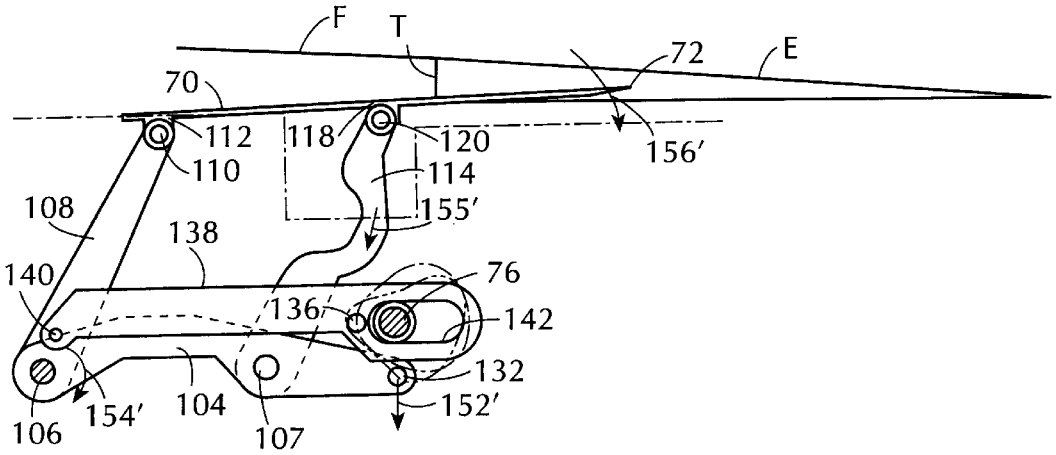
Figure 16B:
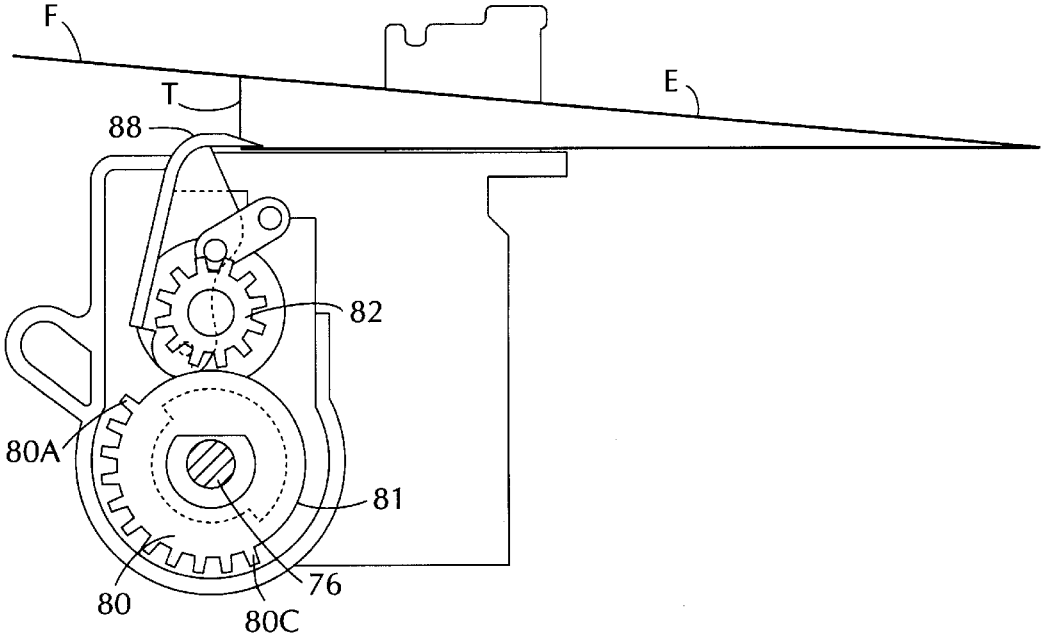

During this same approximately 80° of rotation of the shaft 76, the drive gear 80 is also rotated by the same amount, which brings the lead tooth 80A to the position shown in FIG. 16B, and the sixth tooth 80B in line is now in the position occupied by the lead tooth 80A in FIG. 15B. However, as mentioned above, since the diameter of the driven gear 82 is half of that of the drive gear 80 and has 12 teeth, the movement of six teeth on the drive gear 80 during a quarter of a revolution of the shaft 76 rotates the driven gear 82 through one half of a revolution, which is the peripheral extent of six teeth on this gear. Because of the eccentric pivotal connection 86 of the link 84 on the driven gear 82 and the pivotal connection 86 of the link 90 with the link 84 and the pivotal connection 94 of the link 90 with the frame of the inserting module 12, the link 84 is moved upwardly and oscillated in a counter clockwise direction to bring the claw 88 to the position shown in FIG. 16B where the forward edge of the claws 88 is in contact with the under surface of the flap F and facing the throat T of the envelope E.

Figure 13A:
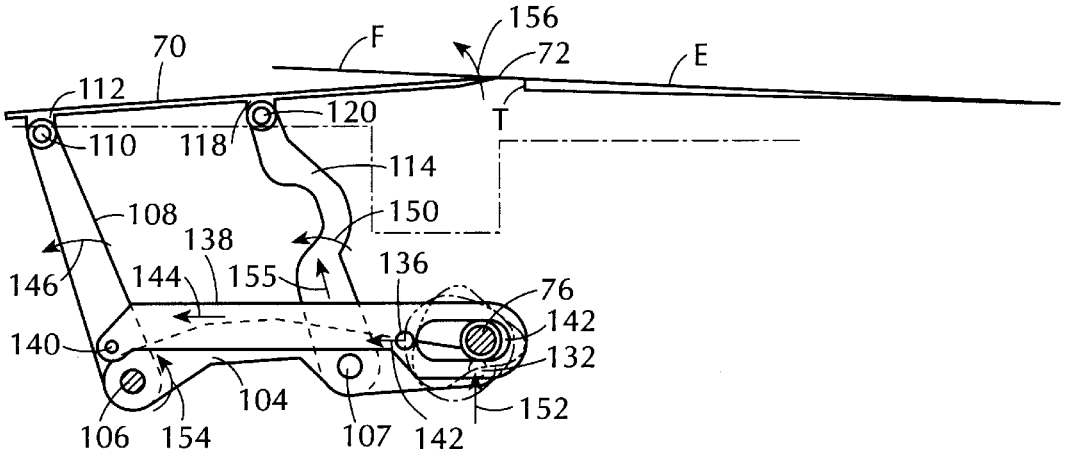

Referring now to FIG. 13A, simultaneously with the foregoing rotation of the cam element 124 and cam traces 130 and 134 the cam trace 130 causes the cam follower 132 to move upwardly, as indicated by the arrow 152, thereby moving the lower links 104 and 105 in a counter clockwise direction about the pivot shaft 106, as indicated by the arrow 154. Since the forward links 114 and 116 are both pivotally connected to the lower links 104 and 105 respectively, the counter clockwise movement of the lower links 104 and 105 raises the forward links 114 and 116, as indicated by the arrow 155, which in turn moves the forward portion of the tongue 70 in a counter clockwise direction about the pivot pin 110 connecting the rear portion of the tongue 70 with the rear link 108, which in turn causes the forward edge 72 of the tongue 70 to rise, as indicated by the arrow 156, to its upper most position. Thus, the parts are now in their rear most and upper most positions, and the movements thereof from the positions shown in FIG. 12A to those shown in FIG. 13A occur during the second approximately 80° of rotation of the shaft 76 and the cam element 124.

Figure 17A:
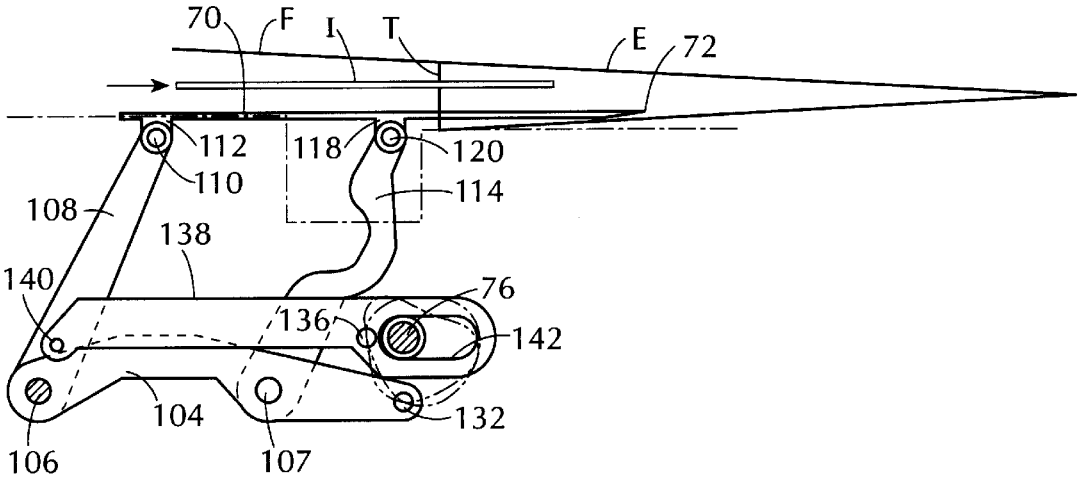
Figure 17B:
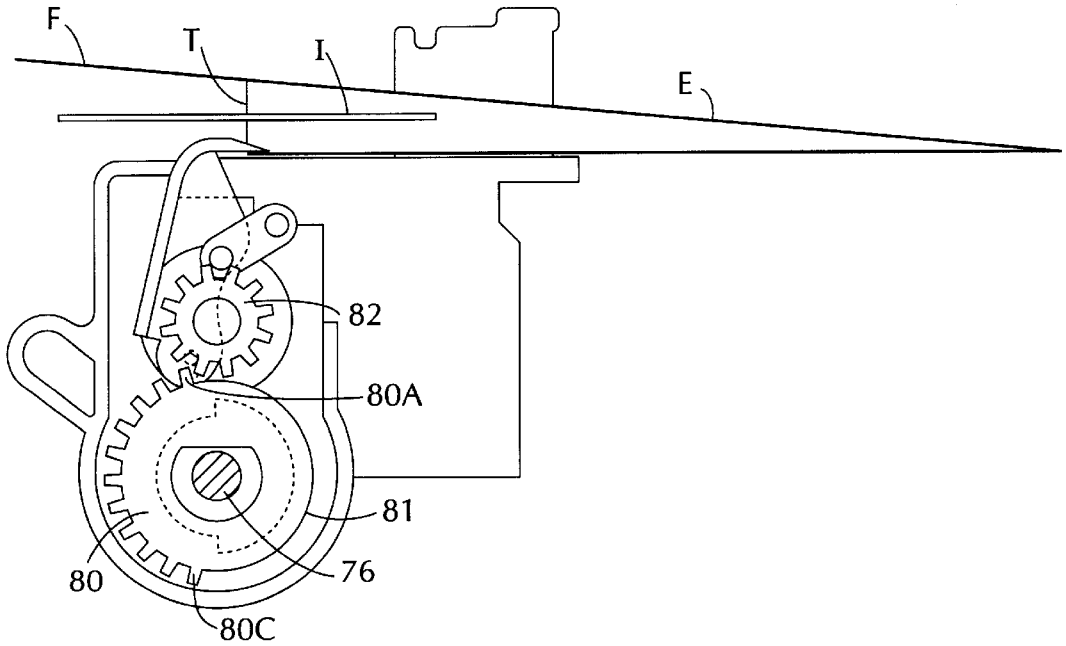

During this approximately second 80° of rotation of the shaft 76, the drive gear 80 is also rotated by the same amount, which brings the lead tooth 80A to the position shown in FIG. 17B, and the last tooth in line 80B is in a position where it is just about to disengage from the meshing teeth of the driven gear 82. However, the movement of the next five teeth on the drive gear 80 during the second approximately 90° of rotation of the shaft 76 still rotates the driven gear 82 through one half revolution because the trailing tooth 80C, which is the eleventh tooth in line, moves past the position of the lead tooth 80A in FIG. 15B and the sixth tooth 80B in FIG. 16B, by the distance of one tooth. The reason for providing only 11 teeth on the drive gear 80 is that the teeth of the drive gear 80 must disengage from the teeth of the driven gear 82 after the latter has been driven through a complete revolution to move the claw 88 into the throat T of an envelope E and open it to the position shown in FIG. 17B. This is accomplished by causing the flat surface portion 81 of the drive gear 80 to move past the teeth on the driven gear 82, with the result that the gear 82 now remains stationary during any further rotation of the shaft 76 and the drive gear 80. If the drive gear 80 had another tooth, this tooth would cause the driven gear 82 to rotate more than approximately 180° which would move the claw 88 out of the normal position in which it holds the end portions of the envelope throat open to the fullest extent.

Figure 13B:
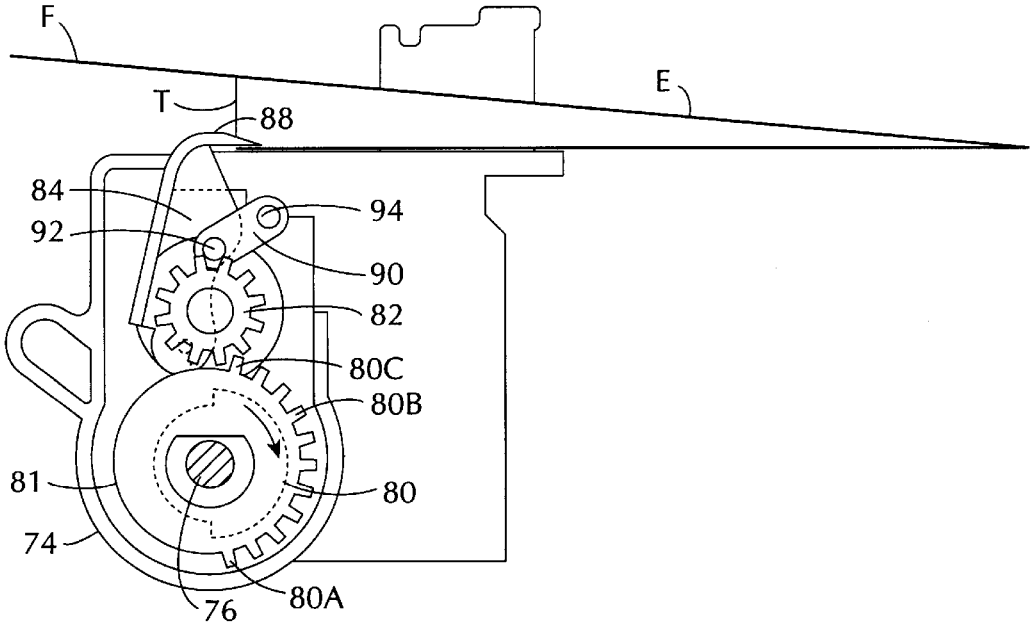
Figure 14A:
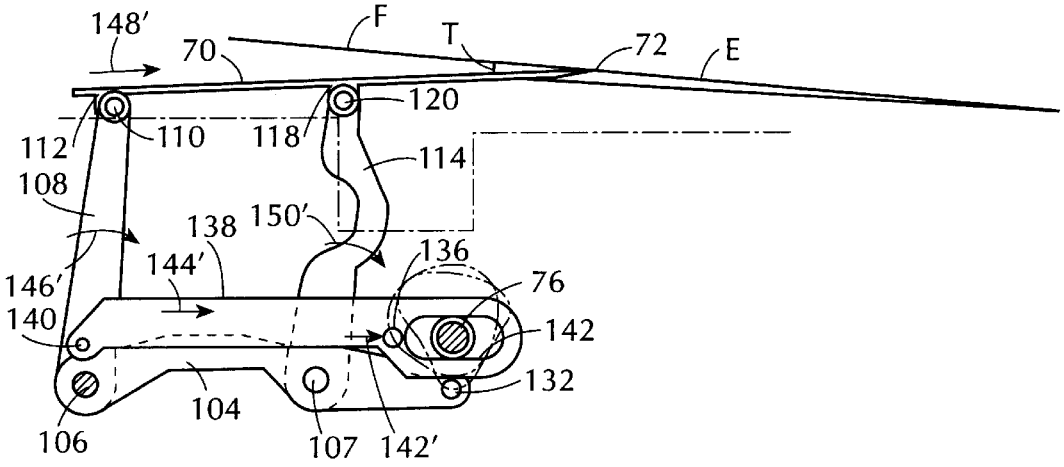
Figure 14B:
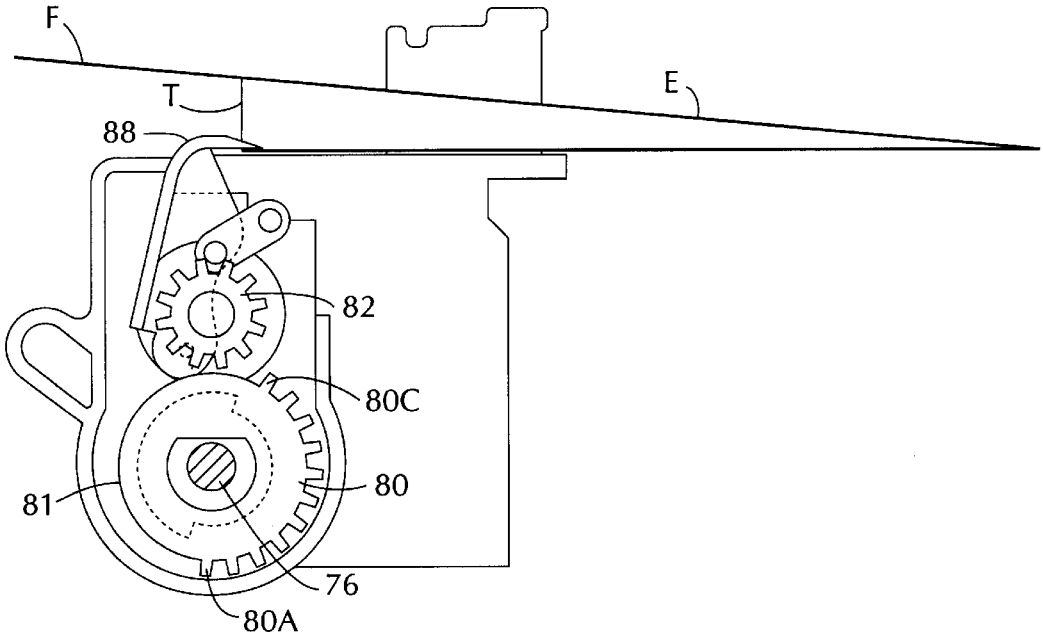

Still referring to FIG. 13B, because of the same pivotal connections between the link 84, gear 82, link 90 and the inserting module frame described above in connection with FIG. 12B, the link 84 is now oscillated in a clockwise direction so as to cause the claw 88 to move forwardly into the throat T of the envelope E shown in FIG. 12B, after which the link 84 is moved downwardly to open the throat T to the position shown in FIG. 13B.

FIGS. 14A through 18A show a progression of the positions of the tongue 70 and the parts of the tongue mounting assembly 100 during continued rotation of the shaft 76 and the cam element 124 from the position shown in FIG. 13A, which causes the cam traces 130 and 132 to move the cam followers 134 and 136 in the opposite directions from that described above in connection with FIGS. 12A and 13A. Thus, the cam trace 134 causes the cam follower 136 to move in a forward direction, as indicated by the reverse direction arrow 142', thereby moving the intermediate link 138 forwardly as indicated by the reverse direction arrow 144'. Due to the same pivotal connections as described above, the forward movement of the intermediate link 138 causes the rear link 108 to rotate in a clockwise direction about the pivot shaft 106, as indicated by the arrow 146', which in turn moves the tongue 72 forwardly, as indicated by the arrow 148', which in turn again moves the forward links 114 and 116 in a clockwise direction about the pivot shaft 107, as indicated by the arrow 150'. The forward movement of the tongue 70 moves the leading edge 72 into the throat T of the envelope E with the tongue still lying in approximately the same plane as it had in the rear most position shown in FIG. 13A. The foregoing motions of the parts described occur during approximately an additional 45° of rotation of the cam element 124, during which, again, the cam follower 132 has been in a dwell portion of the trace 130 and therefore has not moved. This causes the tongue 70 to move forwardly from the position shown in FIG. 17A to that shown in FIG. 18A in substantially the same plane so that the leading edge 72 rubs gently along the underside of the flap F and the inner surface of the front panel of the envelope E as it passes through the throat T and into the envelope E. During this rotation of the shaft 76, the flat surface 81 of the drive gear 80 is engaged with the driven gear 82 with the result that the driven gear 82 does not rotate and the claw 88 remains in contact with the inner surface of the envelope E to maintain the throat T open.

Referring now to FIG. 15A, simultaneously with the foregoing rotation of the shaft 76 and the cam element 124 and the cam traces 130 and 134, the cam trace 130 causes the cam follower 132 to move downwardly, as indicated by the arrow 152', thereby moving the lower links 104 and 105 in a clockwise direction about the pivot shaft 106, as indicated by the arrow 154'. Again, since the forward links 114 and 116 are both pivotally connected to the lower links 104 and 105 respectively, the clockwise movement of the lower links 104 and 105 causes the forward links 114 and 116 to commence a downward movement, as indicated by the arrow 155'. However, the configuration of the cam traces 130 and 134 are such that the tongue 70 is constrained to move in substantially the same plane as that shown in FIG. 13A while moving to the position shown in FIG. 15A. The foregoing movement of the tongue 70 from the position shown in FIGS. 13A through 15A occur during another approximately 115° of rotation of the shaft 76 and the cam element 124. Again, since the flat surface 81 of the drive gear 80 is in engagement with the driven gear 82, the latter does not rotate and the claw 88 remains in the same throat opening position.

Referring now to FIG. 16A, further rotation of the shaft 76 and the cam element 124 causes a downward movement of the forward links 114 and 116 pivots the tongue 72 about the pin 110 in a clockwise direction, as indicated by the arrow 156', so that the forward edge 72 moves downwardly, and opens the throat T to a further extent than is shown in FIG. 15A. In addition, due to further downward movement of the cam follower 132 and the accompanying clockwise pivotal movement of the lower links 104 and 105, the tongue 70 is pivoted in a clockwise direction to lower the front portion still further so that the tongue 70 assumes a more horizontal position, with the result that the lower surface of the tongue 70 is now depressing a greater portion of the inner surface of the rear panel of the envelope E than is shown in FIG. 15A. During this continued rotation of the cam 124 and shaft 76, the driven gear 82 still remains stationary since the flat surface 81 remains engaged with the driven gear 82.

Figure 11A:
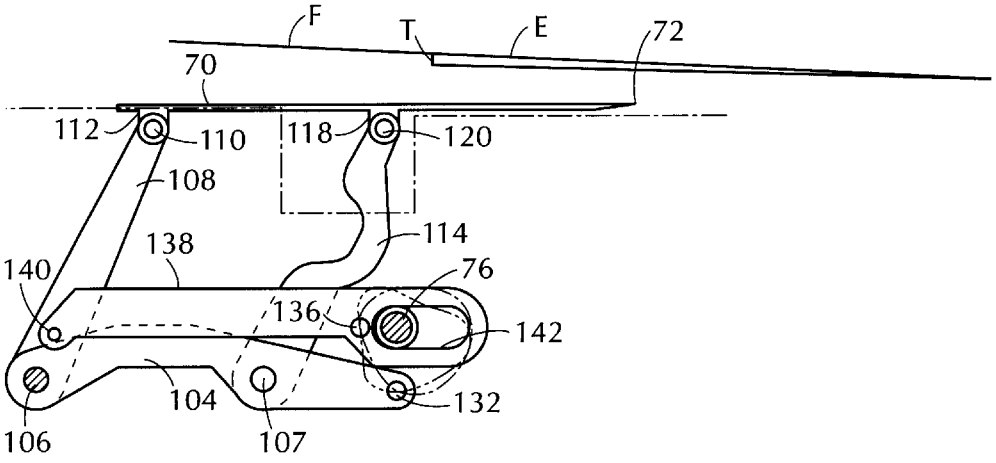
Figure 11B:
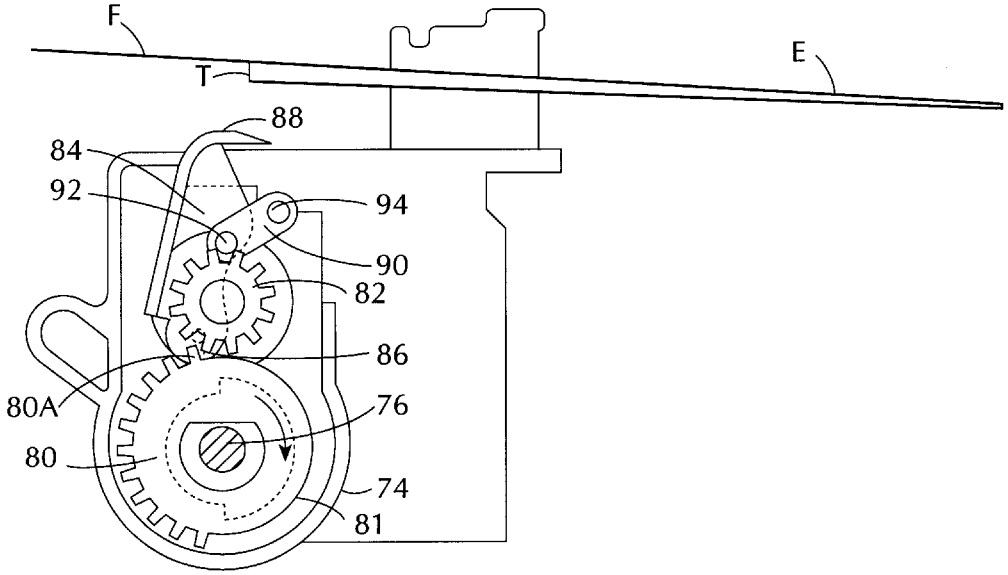
Figure 18A:
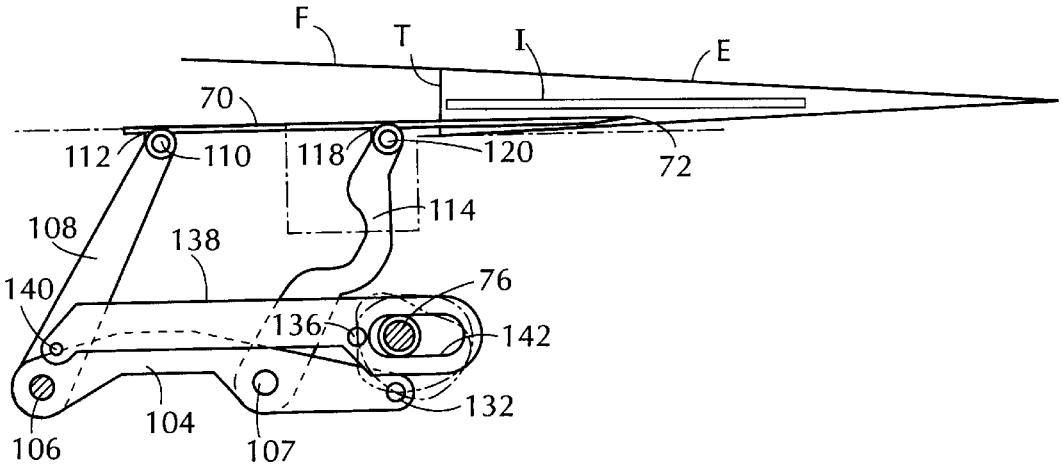
Figure 18B:
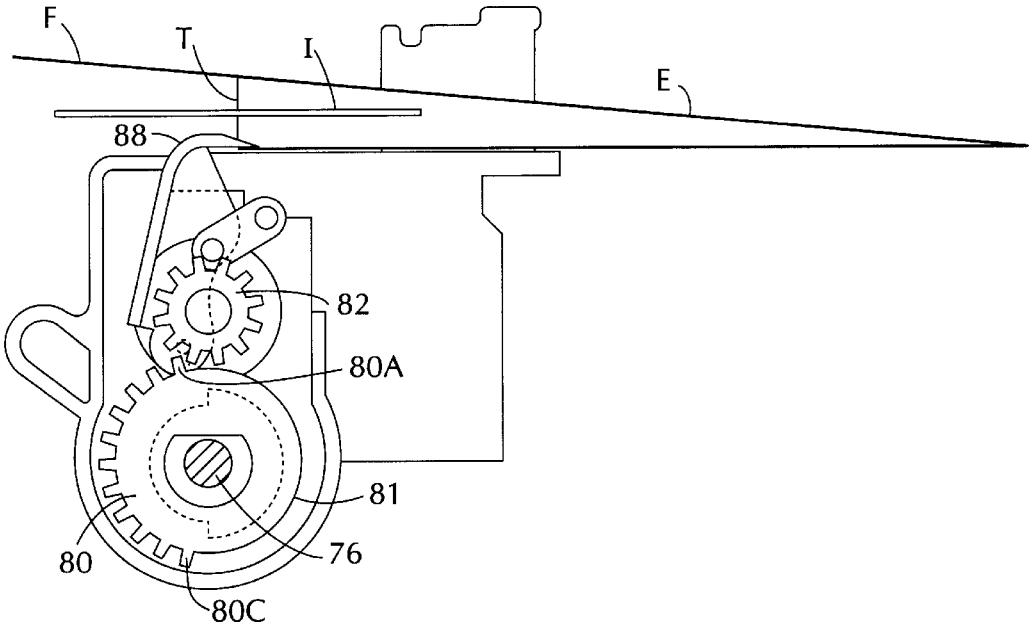

FIG. 17A shows the parts of the tongue 70 and the tongue mounting assembly 100 in the same home positions they occupied in FIG. 11A, with the exception that the tongue 70 is now inside the envelope E and the throat T is being held fully open. At this point, the microprocessor control stops the rotation of the drive shaft 76 so that the parts are held in the position shown in FIG. 17A. The microprocessor then actuates the inserting module 12 to cause a collation of insert material I to be moved into the envelope E through the open throat T, and to be fully inserted into the envelope as shown in FIG. 18A. After this occurs, the microprocessor causes the envelope stop members 46 to raise so that the feed belts 34 and pressure rollers 52 can eject the envelope E from the inserting machine 10 for further processing.

It is to be understood that the present invention is not to be considered as limited to the specific embodiment described above and shown in the accompanying drawings, which is merely illustrative of the best mode presently contemplated for carrying out the invention and which is susceptible to such changes as may be obvious to one skilled in the art, but rather that the invention is intended to cover all such variations, modifications and equivalents thereof as may be deemed to be within the scope of the claims appended hereto.

We claim:

1. An envelope throat opening mechanism for an envelope inserting machine having means for storing a plurality of envelopes, means defining an envelope inserting position in spaced relationship with said envelope storing means in which insert material is adapted to be inserted into said envelopes, and means for feeding envelopes seriatim from said storage means to said inserting position, said envelope throat opening mechanism comprising:

A. a pair of envelope throat opening claw assemblies disposed in said envelope inserting machine adjacent the outer ends of the throat of an envelope in said inserting position, each of said claw assemblies having a claw mounted therein for movement into the throat of said envelope adjacent said outer ends to open said throat to permit insert material to be inserted into said envelope, B. an envelope throat opening center tongue assembly disposed in said envelope inserting machine in substantial lateral alignment with the center of the throat of an envelope in said inserting position for opening the center portion of said throat of said envelope positioned in said inserting position, and C. means for driving said claw assemblies and said center tongue assembly in a timed sequence with the arrival of said envelope at said envelope inserting position, and with said claw assemblies operating asynchronously with respect to said center tongue assembly to cause said claw assemblies to open said outer ends of said throat prior to said center tongue assembly opening said center portion of said throat, whereby said outer ends of said throat are fully opened prior to said center tongue assembly opening said center portion of said tongue to ensure that said center tongue assembly effectively opens said center portion of said throat.

2. An envelope throat opening mechanism as set forth in claim 1 wherein said center tongue assembly comprises A. an elongate, generally rectangular throat opening tongue having a forward edge that is positioned in substantial longitudinal alignment with said claws of said claw assemblies, and B. means mounting said tongue for compound movement such that said forward edge of said tongue moves into the throat of said envelope adjacent said center thereof in response to operation of said driving means for opening said center portion of said throat.

3. An envelope throat opening mechanism as set forth in claim 2 wherein said means for driving said claw assemblies and said mounting means for said tongue comprises A. a drive shaft rotatably mounted in said envelope inserting machine, B. actuating means for said claw assemblies and said tongue mounting means connected to said drive shaft for moving both said claws and said tongue, and C. means for rotating said drive shaft.

4. An envelope throat opening mechanism as set forth in claim 3 wherein said actuating means for said claw assemblies and said tongue mounting means comprises A. first actuating means for causing said compound movement of said tongue mounting means to move said forward edge of said tongue into said throat of said envelope, and B. second actuating means for causing said claw assemblies to move said claws into said throat of said envelope, said second actuating means including means for causing said claws to enter said throat of said envelope in advance of said forward edge of said tongue entering said throat of said envelope by said first actuating means.

5. An envelope throat opening mechanism as set forth in claim 4 wherein said first actuating means comprises A. cam means mounted on said drive shaft for rotation therewith, and B. means interconnecting said cam means with said tongue mounting means for moving said tongue mounting means through said compound movement to move said forward edge of said tongue into said throat of said envelope during a predetermined amount of rotation of said drive shaft and said cam means.

6. An envelope throat opening mechanism as set forth in claim 5 wherein said second actuating means comprises A. a first driving element mounted on said drive shaft within said each of said claw assemblies for rotation with said drive shaft, and B. a second driving element rotatably mounted within each of said claw assemblies for moving said claws, and C. means interconnecting said first and second driving elements for driving said second driving element at a slower speed than said first driving element.

7. An envelope throat opening mechanism as set forth in claim 5 wherein said means interconnecting said first and second driving elements comprises said first and second driving elements comprising first and second gears having a drive ratio of approximately 2:1 such that said second gear travels approximately twice the distance of said first gear for a given amount of rotation of said drive shaft, such that said claws are thereby moved at approximately twice the speed of said forward edge of said tongue.

8. An envelope throat opening mechanism as set forth in claim 7 wherein said appropriately 2:1 drive ratio is achieved by said first gear being approximately twice the diameter of said second gear so that said second gear is driven through a full revolution in response to said first gear being driven through one half of a revolution by said drive shaft.

9. An envelope throat opening mechanism as set forth in claim 8 wherein said means interconnecting said first and second driving elements further includes means for permitting said second gear to remain stationary while said first gear is driven through the remaining half of a revolution by said drive shaft.

10. An envelope throat opening mechanism as set forth in claim 9 wherein said means for permitting said second gear to remain stationary during the second half revolution movement of said drive shaft comprises said first gear having teeth over approximately only one half of the periphery thereof, the remaining portion of the periphery thereof being a smooth surface.

* * * * *